US007331732B2

(12) United States Patent
Kaneda

(10) Patent No.: US 7,331,732 B2
(45) Date of Patent: Feb. 19, 2008

(54) LOOSE-LEAF BINDING TOOL

(76) Inventor: Kokki Kaneda, 9-15, Chuo 2-chome, Ota-ku, Tokyo (JP)

( * ) Notice: Subject to any disclaimer, the term of this patent is extended or adjusted under 35 U.S.C. 154(b) by 392 days.

(21) Appl. No.: 10/987,247

(22) Filed: Nov. 12, 2004

(65) Prior Publication Data

US 2006/0104708 A1 May 18, 2006

(51) Int. Cl.
*B42F 13/20* (2006.01)
*B42F 3/04* (2006.01)

(52) U.S. Cl. ..... 402/31; 402/36; 402/38

(58) Field of Classification Search ..... 402/19, 402/20, 26, 27, 28, 46, 55, 56, 58, 59, 31, 402/37, 38, 70, 73, 80 R, 500, 502
See application file for complete search history.

(56) References Cited

U.S. PATENT DOCUMENTS

| | | | | |
|---|---|---|---|---|
| 840,643 | A * | 1/1907 | Morden | 402/20 |
| 5,716,153 | A * | 2/1998 | Aiello | 402/46 |
| 6,761,497 | B2 * | 7/2004 | Kaneda | 402/31 |
| 2006/0056907 | A1 * | 3/2006 | Busam et al. | 402/46 |

FOREIGN PATENT DOCUMENTS

| | | |
|---|---|---|
| JP | 2001-010273 | 1/2001 |
| JP | 2003-211886 | 7/2003 |

* cited by examiner

*Primary Examiner*—Monica Carter
*Assistant Examiner*—Pradeep C Battula
(74) *Attorney, Agent, or Firm*—Drinker, Biddle & Reath LLP.

(57) ABSTRACT

A binding tool includes an elongated substrate, a pair of rotatable shafts, and engageable binding rings on the shafts. The shafts are rotatably supported on the substrate. An operation plate on the substrate is slidable along the shafts. The shafts have cam protrusions. The operation plate has cam grooves acting on the cam protrusions to rotate the shafts. When the operation plate is in one end position, the cam protrusion rotates the shaft to separate the binding rings. In the other end position, the shaft is rotated to engage the binding rings. Each shaft has an engagement plate protruding toward the operation plate. The operation plate has at least one cutout and an engaging portion. The engagement plate engages with the engaging portion of the operation plate when the operation plate is in the one end position. The cutout is aligned with the engagement plate to release the engagement plate in other positions.

2 Claims, 13 Drawing Sheets

B—B (a)

(b)

LOOSE-LEAF BINDING TOOL

BACKGROUND OF THE INVENTION

1. Field of the Invention

The present invention relates to a loose-leaf binding tool, particularly to a loose-leaf binding tool of such a type that a fingerhold of an operation plate is pulled or pushed to thereby open/close binding rings.

2. Description of the Related Art

Various types have been proposed with regard to a loose-leaf binding tool of such a type that a fingerhold of an operation plate is pulled or pushed to thereby open/close binding rings. The present invention relates to a binding tool in which two rows of binding rings are fixed to a pair of rotatable shafts which are rotatably supported by a fixed substrate along its longitudinal edges.

FIGS. 1(*a*), (*b*), (*c*) show a main part of this type of conventional loose-leaf binding tool.

This binding tool is constituted of three members: an elongated fixed-side substrate 1 on which a plurality of first binding rings 3 are arranged at predetermined intervals; a rotatable shaft 2 on which a plurality of second binding rings 4 engageable with the first binding rings 3 are disposed and which is attached to one side portion of the substrate 1; and an operation plate 5 disposed along the shaft 2 on the bottom surface of the substrate 1 and movable in a longitudinal direction of the substrate 1. The operation plate 5 has a fingerhold 8 on a front end thereof. The fingerhold is operated forwards/backwards to thereby slide the operation plate 5 in the longitudinal direction of the binding tool, and accordingly the shaft 2 is rotated to close the binding rings 4 on a movable side toward the binding rings 3 on the fixed side or detach the rings 4 from the rings 3.

To transform linear movement of the operation plate 5 into a rotary movement of the shaft, a cam mechanism is formed on facing surfaces of the shaft and the operation plate. That is, a cam protrusion 6 protruding toward the operation plate 5 is disposed on the shaft, and a cam groove 7 into which the cam protrusion 6 fits is disposed in the operation plate 5 (conversely, there is also an example in which the cam protrusion is disposed on the operation plate and the cam groove is disposed in the shaft). The cam groove 7 is shaped in such a manner that when the operation plate 5 is pushed in a push-in position, the shaft 2 is rotated via the cam protrusion 6 to engage the second binding rings 4 with the first binding rings 3. When the operation plate 5 is pulsed in a pull-out position, the shaft 2 is rotated in an opposite direction via the cam protrusion 6 to thereby detach the second binding rings 4 from the first binding rings 3.

In this conventional example, since the movement of the operation plate 5 in the longitudinal direction is smoothly transformed into the rotary movement of the shaft 2, there is no substantial resistance in the operation. Opposite end portions of the cam groove extend in the longitudinal direction. Therefore, there is an advantage that the binding rings 4 on the movable side are stably fixed in closed and opened positions, when the cam protrusion 6 fits in the groove.

However, even when a positional relation between the cam protrusion and the cam groove is designed in such a manner that the binding rings disposed in the closed positions are tightly engaged, a portion is generated in which the engagement between the binding rings is not sufficient. A problem occurs that a part of loose-leaf is bitten between the binding rings by its own weight or an external force such as shock, and therefore there has been a demand for a binding tool which does not have such problem. Another problem is that the opening of the rings of the movable side is not sufficient for inserting and removing sheets of loose leafs having holes.

SUMMARY OF THE INVENTION

According to the present invention, the above-described problem can be solved by a mechanism in which at least two engagement plates or elastic plates for urging a pair of shafts supporting binding rings on rotatable shafts in a closing direction of binding rings and which allows the plates to be operated only at the time of closing of the binding rings.

That is, according to the present invention, there is provided a binding tool comprising: A binding tool including an elongated substrate having a plurality of openings along longitudinal opposite edges of the substrate at predetermined intervals; a pair of rotatable shafts on which a plurality of first and second binding rings engageable with each other are fixed and protrude through said openings, said shafts being rotatably supported on both side portions of the substrate; and a slidable operation plate disposed along the shaft on the bottom surface of the substrate, movable in a longitudinal direction of the substrate and having a fingerhold on a front end thereof, each of the shafts being provided with a cam protrusion protruding toward the operation plate on at least one port on thereof, the operation plate being provided with a cam groove acting on the cam protrusion to thereby rotate each of the shafts, the shape of the cam groove being determined in such a manner that each of the shafts is rotated via the cam protrusion to thereby engage the first binding rings with the second binding rings, when the operation plate is pushed in a push-in position, and the shaft is rotated in an opposite direction via the cam protrusion to thereby detach the first binding rings from the second binding rings, when the operation plate is pulled in a pull-out position, wherein each of the shafts has an engagement plate protruding toward the operation plate on at least one portion along the longitudinal direction, the operation plate has at least one cutout and an engaging portion on a bottom-surface side in a movement range corresponding to the engagement plate, the engagement plate engages with the engaging portion of the operation plate, when the operation plate is in the push-in position, and the cutout is aligned in the position of the engagement plate to thereby release the engagement plate, when the engagement plate moves to a position other than the push-in position.

According to the constitution, when the operation plate is in the push-in position, the engagement plate is further pressed in a closing direction by the bottom-surface engaging portion of the operation plate. Therefore, each of the shafts further rotates, and a function of allowing the binding rings on one side or edge to strongly collide and engage with the binding rings on the other side or edge.

In a preferable mode of the present invention, the engaging portion of the operation plate bottom surface has an inclined surface in a portion adjacent to the cutout. Therefore, when the operation plate is slid into the push-in position, the engagement plate is guided by the inclined surface, receives a gradually increasing reactive force while shifting to the engaging portion, and is capable of applying a gradually increasing force to the binding rings via the shaft.

In a preferable mode of the present invention, the cutout has a rectangular shape opened on the side of the engagement plate to thereby produce a space for rotating the engagement plate centering on the shaft.

In a preferable mode of the present invention, the opposite ends of the cam groove comprise linear paths extending along the longitudinal direction of the operation plate, and an intermediate portion comprises an inclined path connected to the linear paths. Accordingly, a function of maintaining opened binding rings against an external force applied at the time of replacement/replenishment of a loose leaf.

According to the present invention, in the binding tool of such a type that the shaft supporting the binding rings is rotated by a sliding type operation plate, the binding rings are securely closed, and the loose leaf can be prevented from being bitten in the binding rings or being detached.

DESCRIPTION OF THE PREFERRED EMBODIMENT

An embodiment of the present invention will be described in detail with reference to FIGS. 2 to 19.

A binding tool of the present invention comprises a substrate, shafts provided with binding rings and an operation plate. Any of the members can be made of a tough synthetic resin such as polypropylene or ABS.

Figure 1:
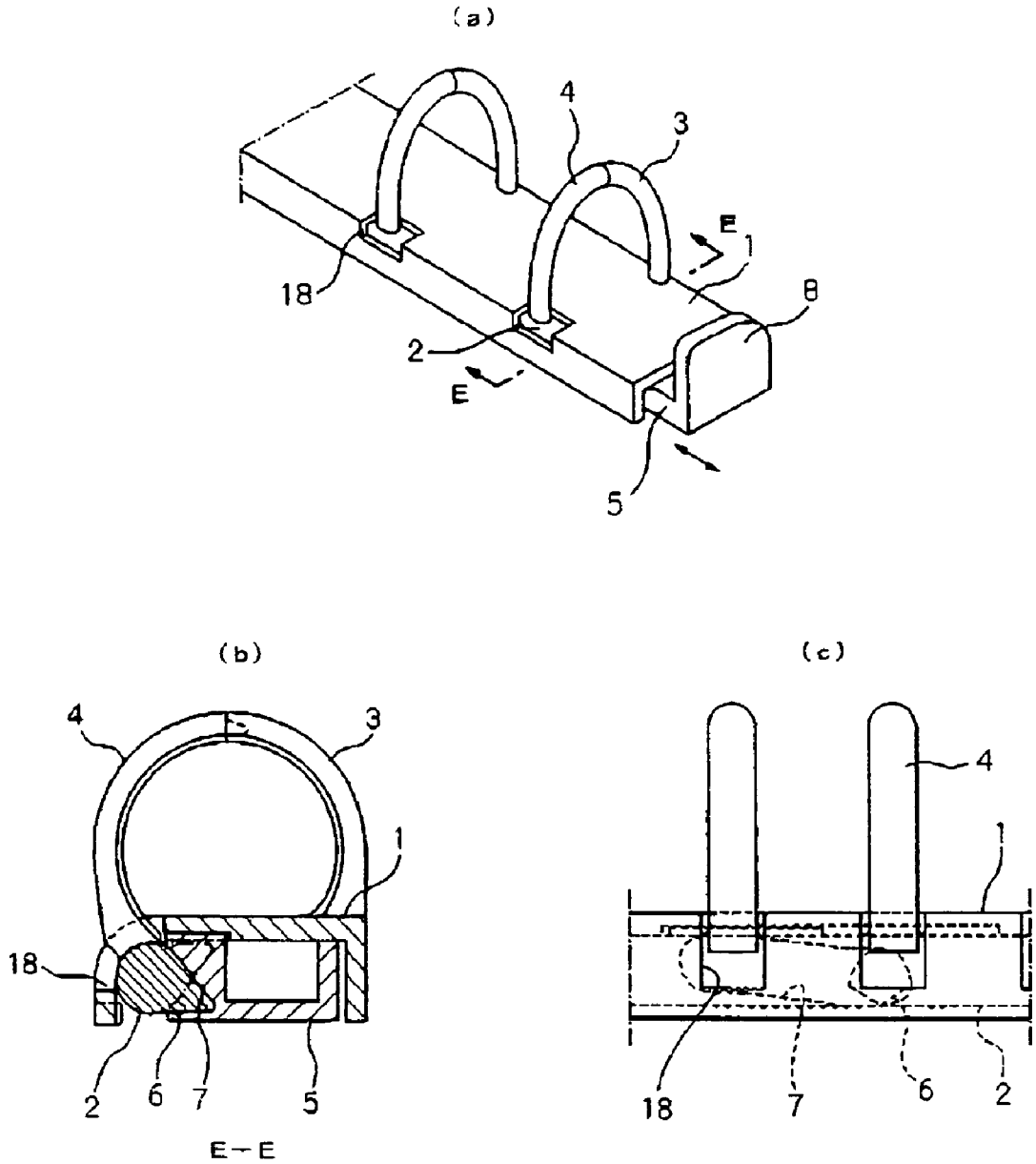
FIG. 1 PRIOR ART
FIG. 1 is a diagram showing a binding tool of such a type that a shaft supporting conventional binding rings is rotated by a sliding type operation plate wherein (a) is partial perspective view, (b) is a cross sectional view taken along the line E-E of (a) and (c) is a partial front view of a part of the binding tool.
Figure 2:
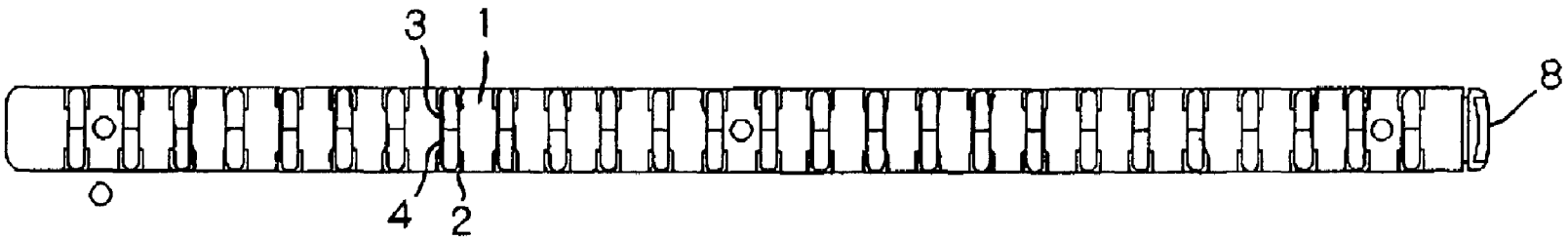
FIG. 2 is a plan view of the binding tool of the present invention.
Figure 3:
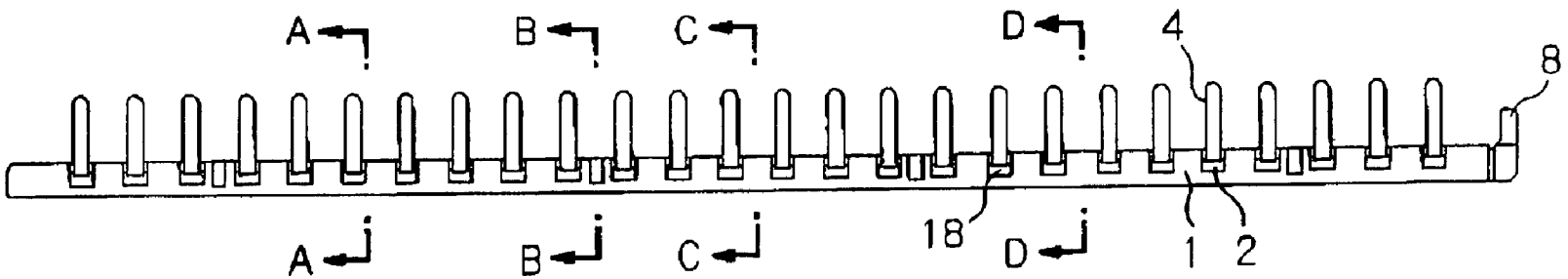
FIG. 3 is a front view of the binding tool of the present invention.
Figure 4:
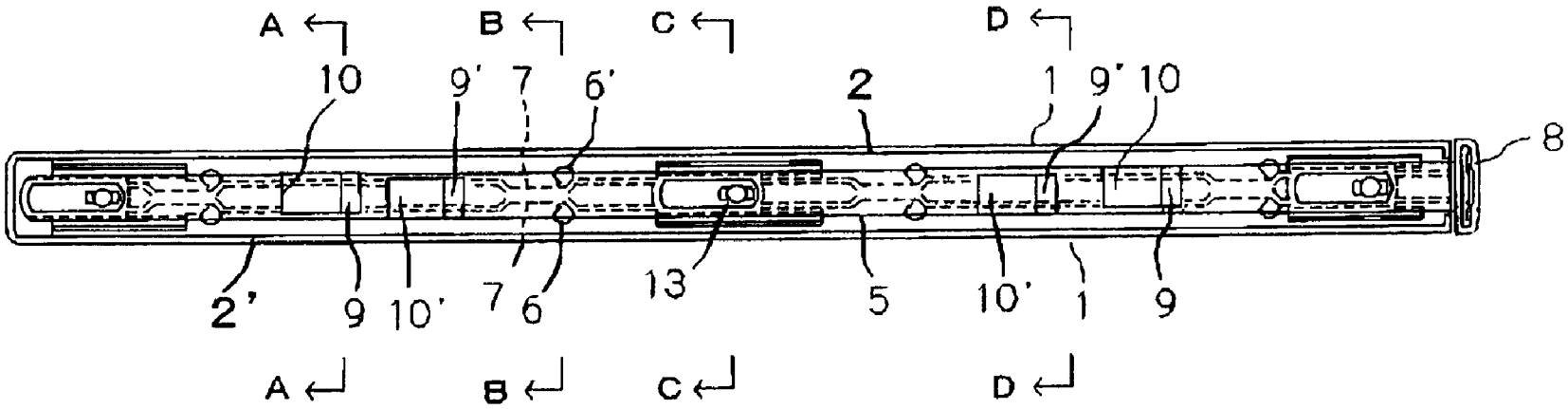
FIG. 4 is a bottom plan view of the binding tool of the present invention.

In FIGS. 2 to 4 showing the whole binding tool according to the embodiment of the present invention, FIG. 2 is a plan view of the binding tool, FIG. 3 is a front view, and FIG. 4 is a bottom plan view. The binding tool comprises: a fixed elongated substrate 1 having openings 18 formed along opposite edges of the substrate 1 at predetermined intervals, a plurality of first binding rings 3 and second binding rings 4 protruding respectively through the openings 18; a pair of rotatable shafts 2 on which the first and second binding rings engageable with each other at free ends are integrally mounted, said shafts being rotatably supported respectively at both side portions of the substrate 1; and a slidable operation plate 5 disposed along and between the shafts 2 on the bottom surface of the substrate 1, movable in a longitudinal direction of the substrate 1 and having a fingerhold 8 on a front end thereof.

Figure 5:
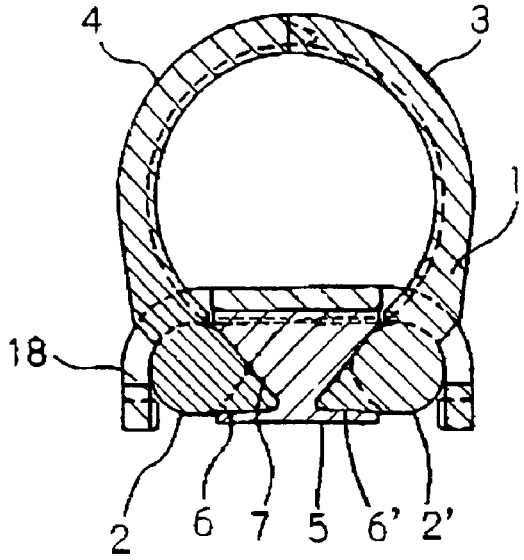
FIG. 5 is a B-B enlarged sectional view of FIGS. 3, 4 showing a pair of cam mechanisms of the binding tool of the present invention.
Figure 6:
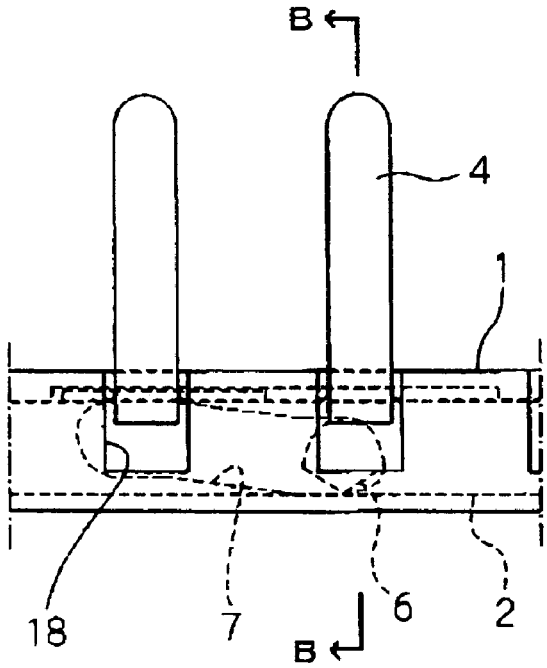
FIG. 6 is an enlarged front view showing the cam mechanism of the binding tool of the present invention.
Figure 7:
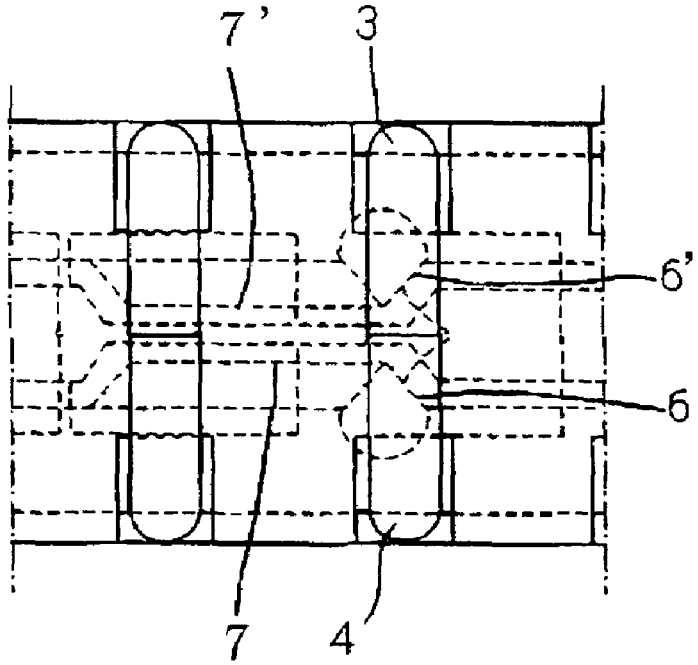
FIG. 7 is an enlarged plan view showing the cam mechanisms of the binding tool of the present invention.

As shown in FIGS. 5 to 7, cam protrusions 6 and 6' protruding toward the operation plate 5 is disposed on at least one portion (four portions in an example shown in FIGS. 2 to 5) of an entire length of each of the shafts 2, 2'. A cam grooves 7 acting on the cam protrusion 6 and 6' to thereby rotate the shafts 2 and 2' is disposed in the side surface of the operation plate 5. When the operation plate 5 is pulled or pushed in a longitudinal direction of the binding tool by a fingerhold 8, the cam protrusions 6 and 6' relatively moved along the cam grooves 7 to thereby rotate the shafts 2 and 2'. Accordingly, the first binding rings 3 are opened/closed with respect to the other binding rings 4. A shape of each cam groove 7 is determined in such a manner that the binding rings 3 on one side are allowed to collide at the distal ends and engage with the other rings 4 on the other side, when the operation plate 5 is pushed in a push-in position, and the shaft 2 is rotated in an opposite direction to thereby detach the binding rings 3 on one side from the binding rings 4 on the other side, when the operation plate 5 is pulled in a pull-out position.

Figure 19:
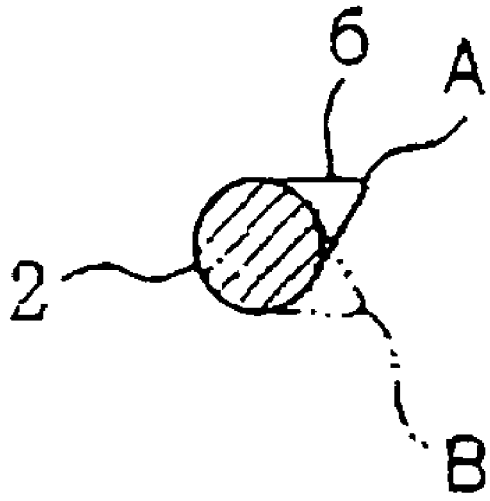
FIG. 19 is a diagram showing a function of a cam mechanism for opening/closing the binding ring, (a) is a sectional view of a rotation shaft, and (b) is a front view of the rotation shaft.
Figure 19:
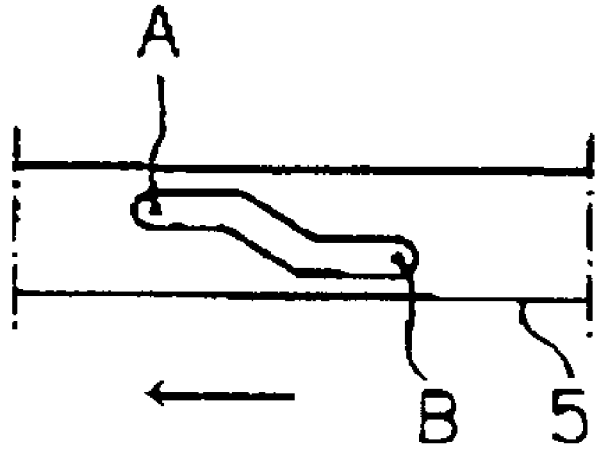

FIG. 19 shows movement of a cam mechanism. When the operation plate 5 is pushed and slid as shown by an arrow, the cam protrusion 6 or 6' protruding from the shaft 2 or 2' receives a rotation-direction component force of a force exerted by the upper wall surface of the cam groove 7, and rotates from A position which is an opened ring position to B position to close the binding rings 3 with respect to the binding rings 4 on a fixed side. Conversely, when the operation plate 5 is pulled in a direction opposite to the arrow, the cam protrusion 6 or 6' receives an opposite-rotation-direction component force of a force exerted by the lower wall surface of the cam groove 7, and moves from B position which is a closed ring position to A position to open the closed ring.

Figure 8:
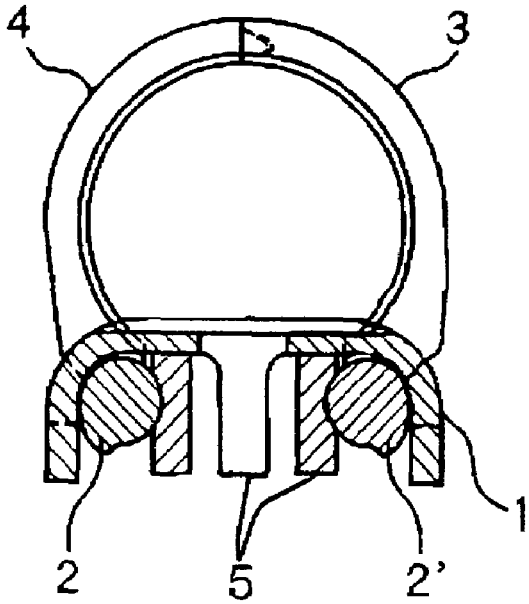
FIG. 8 shows a C-C enlarged sectional view of FIGS. 3, 4 showing a closed state of the binding rings.
Figure 9:
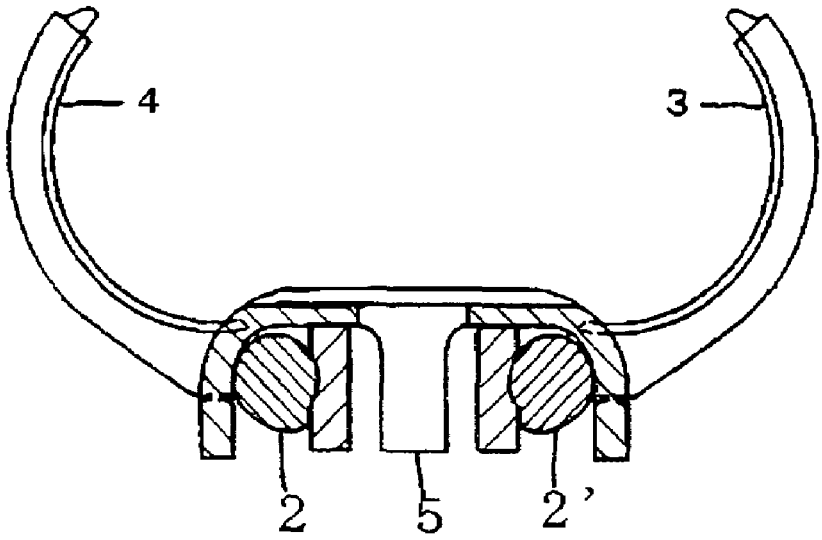
FIG. 9 is an enlarged plan view showing a state in which the binding rings are opened in the same section.
Figure 10:
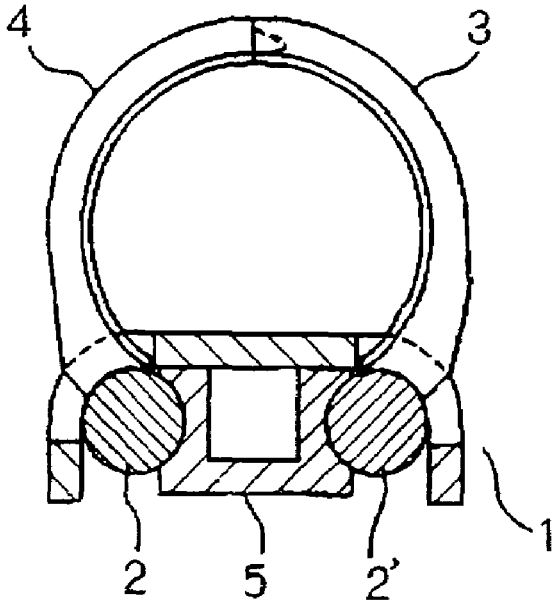
FIG. 10 is a D-D enlarged sectional view of FIGS. 3, 4.
Figure 11:
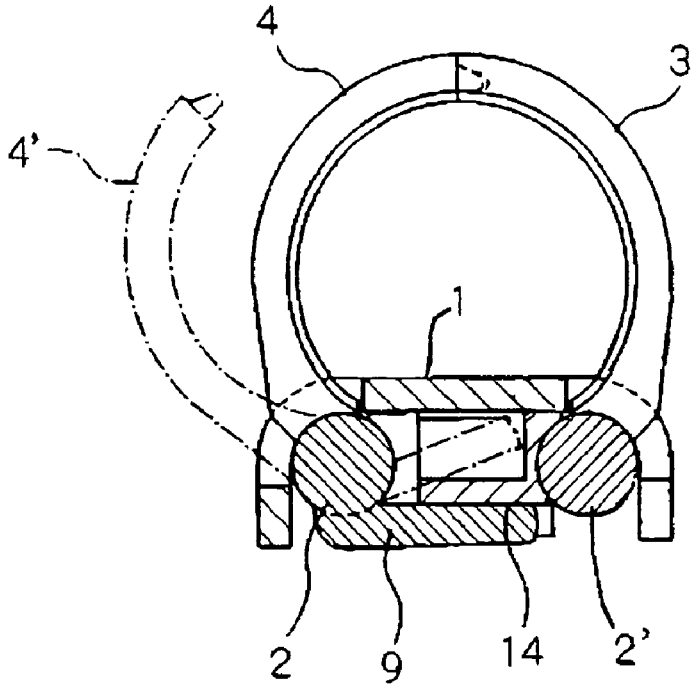
FIG. 11 is an A-A enlarged sectional view of FIGS. 3, 4 showing a structure of an engagement plate and an engaging portion of the present invention.
Figure 12:
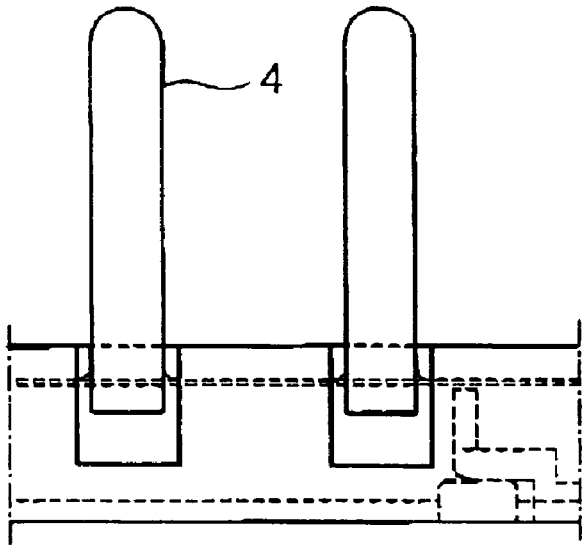
FIG. 12 is an enlarged front view showing the structure of the engagement plate and engaging portion of the binding tool of the present invention.
Figure 13:
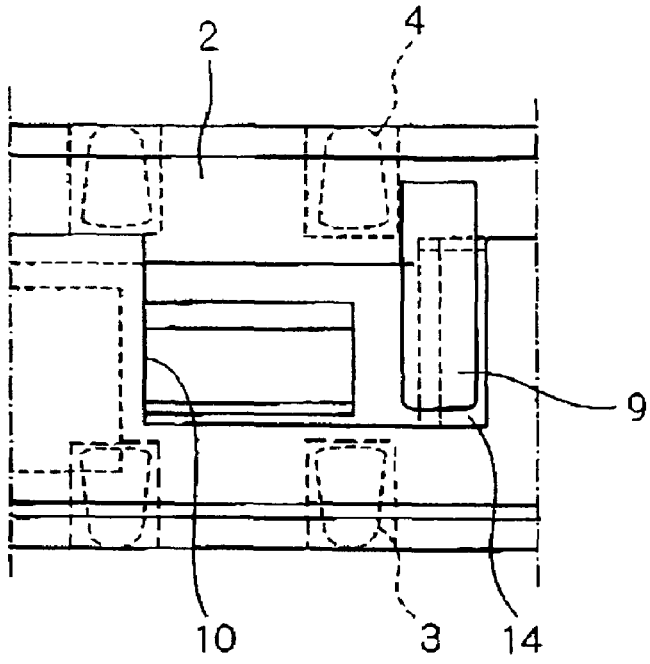
FIG. 13 is an enlarged bottom plan view showing the structure of the engagement plate and engaging portion of the binding tool of the present invention.
Figure 14:
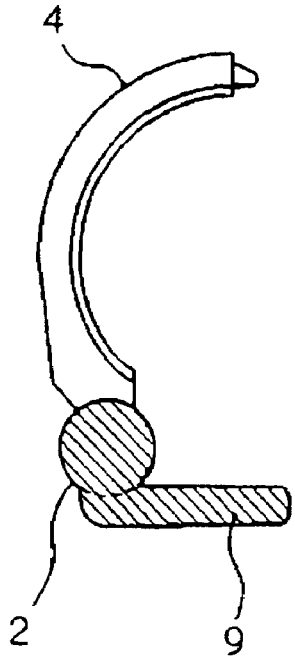
FIG. 14 is a sectional view showing a shaft supporting the binding ring on the movable side and the engagement plate in the A-A enlarged sectional view of FIG. 1.
Figure 15:
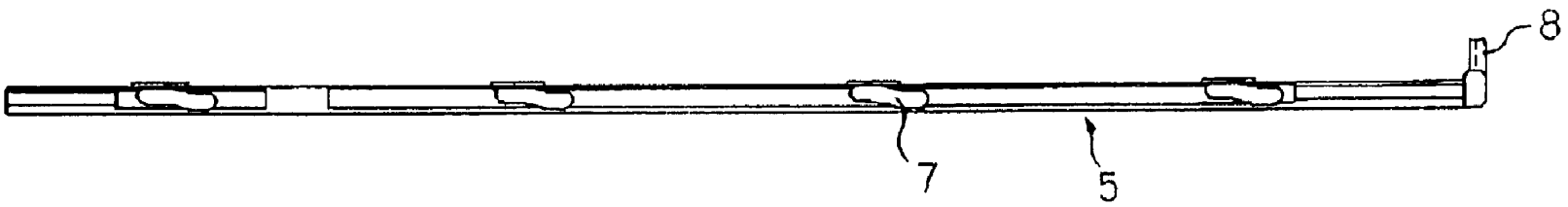
FIG. 15 is a front view showing the operation plate of the binding tool of the present invention.

It is to be noted that, as shown in FIGS. 4 and 8, a stopper 13 extends into an elliptical hole 16 of the operation plate 5 from the substrate 1, and a push-in position and a pull-out position of a longitudinal direction of the operation plate 5 are determined in cooperation with the end face of the elliptical hole 16 in the longitudinal direction. Furthermore, a through hole is formed in the stopper 13, and serves as an attaching hole for attaching tool to a cover sheet. As shown in FIGS. 8 and 9, a bearing groove 17,17' of a longitudinal direction for supporting the shafts 2, 2 are formed in a shaft-side edge portion of the operation plate 5. The bearing grooves 17,17' constitute a bearing together with a circular face of the back surface of the substrate 1, and rotatably supports the shafts 2,2'. The binding rings 3, 4 protrude from openings 18 disposed at a certain interval in the substrate.

Next, a locking mechanism which is characteristic parts of the present invention will be described in detail with reference to FIGS. 11 to 16.

Figure 16:
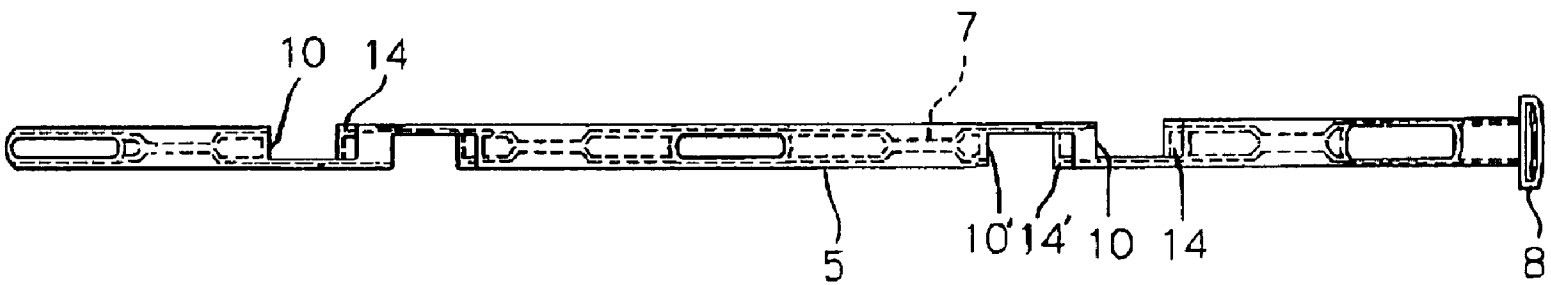
FIG. 16 is a bottom plan view of the operation plate.
Figure 17:
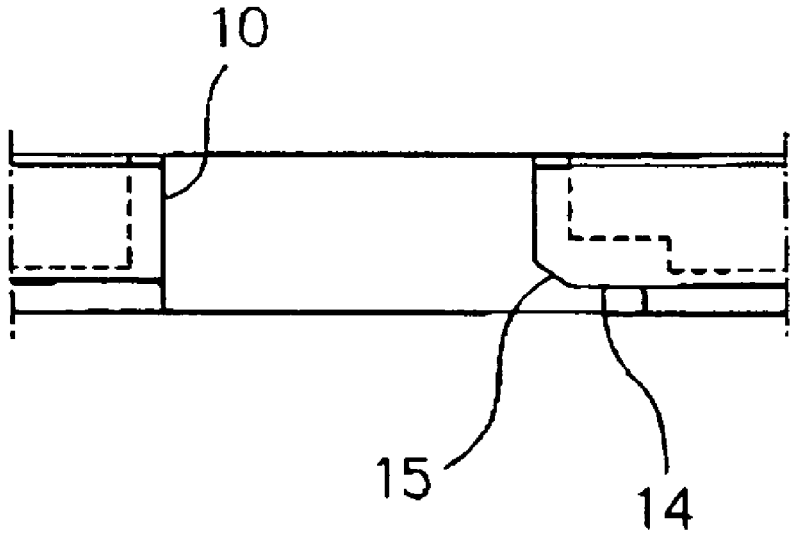
FIG. 17 is a partially enlarged front view showing a cutout and engaging portion of the operation plate.
Figure 18:
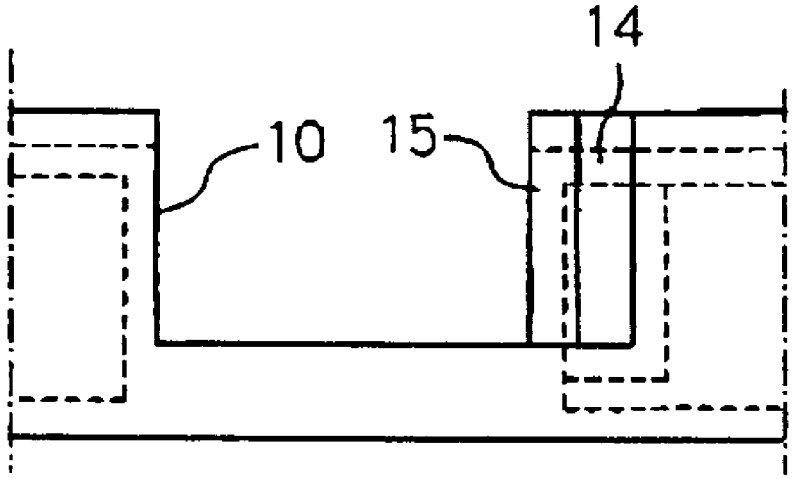
FIG. 18 is a partially enlarged bottom plan view showing the cutout and engaging portion of the operation plate.

The shaft 2 integrally has engagement plates 9 protruding toward the operation plate 5 on two portions (generally at least one portion in accordance with a length of the binding tool) along the longitudinal direction, and as shown in FIGS. 4 16 and the operation plate 5 is provided with rectangular cutouts 10, 10' and engaging portions 14, 14' on the bottom surface of the operation plate in a movement range corresponding to the engagement plates 9.

For the sake of brevity, only one locking mechanism for the shaft 2 will be explained in detail, but it should be understood that at least one locking mechanism (two in this embodiment) is provided at more than one locations for each of the rotatable shafts 2 and 2'

The engagement plate 9 is cantilever-supported by the shaft 2, and therefore has an elastic function. The engaging portion 14 may be the bottom surface of the operation plate 5, or may be a concave face to such an extent that a thickness of the engagement plate 9 is contained as in the present example.

A positional relation among the engagement plate 9, cutout 10, and engaging portion 14 is as follows. When the operation plate 5 is in the push-in position, the engagement plate 9 is aligned with the engaging portion 14 on the bottom surface of the operation plate 5, and strongly engages with the engaging portion 14. Therefore, the engagement plate 9 rotates the shaft 2 in the closing direction of the binding ring by a reactive force from the engaging portion 14, and further a closing force is maintained even after the binding rings are closed. When the engagement plate 9 moves to a position other than the push-in position, the cutout 10 is aligned in the position of the engagement plate 9 to thereby release the engagement plate 9. Accordingly, the shaft 2 is rotatable via the cam groove 7 and the cam protrusion 6 by movement of the operation plate 5 in the longitudinal direction.

An inclined surface 15 is preferably disposed on the engaging portion 14 in a portion adjacent to the cutout 10 in such a manner that the engagement plate 9 can smoothly move among the cutout 10, the engaging portion 14, and the cutout 10.

Next, an operation of the binding tool of the present invention will be described. In a state of FIGS. 2 to 4, the operation plate 5 is disposed in the push-in position, and the binding rings 3, 4 are in an engaged state. When the fingerhold 8 is pulled with respect to the substrate 1, the cam groove 7 of the operation plate 5 relatively moves with respect to the shaft 2. However, since the cam protrusion 6 is first in the linear path of a lower position on a fingerhold side (see FIG. 6). Therefore, the cam protrusion 6 does not move. However, when the operation plate 5 is further pulled, the cam protrusion 6 moves to the inclined path from the linear path, the shaft 2 rotates together with the cam protrusion 6, and the cam protrusion 6 enters the linear path of a higher position from the inclined path, and the binding rings 4 are completely opened (see FIG. 9).

Conversely, to close the binding rings, when the operation plate 5 is pushed into the substrate 1 from the pull-out position, inverse movement occurs, the shaft 2 rotates in reverse, and the binding rings are completely closed.

When a pull tab is further pushed in from this state, the engagement plate 9 contacts the inclined surface 15 (see FIGS. 17 and 18) from the cutout 10, and is guided and finally engaged with the engaging portion 14. Accordingly, the engagement plate 9 receives a reactive force from the engaging portion 14 to further urge the shaft 2 and the binding ring 4 in the closing direction, and the binding rings 3, 4 are maintained in closed states.

In the present invention, by using the two rotatable shafts, it is easy to insert or remove holed loose leaves into and from the binding rings because the distance between the free engaging ends of the first and second binding rings are wide-opened when the operating plate is pulled.

What is claimed is:

1. A binding tool including an elongated substrate;

a pair of rotatable shafts rotatably supported on both side portions of the substrate;

a plurality of first and second binding rings fixed on the shafts; and a slidable operation plate disposed along the shafts on a bottom surface of the substrate, movable in a longitudinal direction of the substrate and having a fingerhold on a front end thereof; wherein:

each of the shafts is provided with a cam protrusion;

the operation plate is provided with cam grooves receiving the cam protrusions, the cam grooves having an inclined path to rotate each of the shafts as the operation plate is moved in the longitudinal direction;

when the operation plate is in a first end position, the shaft is rotated in one direction via the cam protrusion to separate the first binding rings from the second binding rings, and when the operation plate is in a second end position, the shaft is rotated in the opposite direction via the cam protrusion to engage the first binding rings with the second binding rings;

each of the shafts has an engagement plate protruding toward the operation plate on at least one portion along the longitudinal direction;

the operation plate has a cutout passing from a bottom surface to a top surface through a side of the operation plate facing each engagement plate and an engaging portion on the bottom surface adjacent to the cutout, so positioned that when the operation plate is in the second end position the respective engagement plate engages under the engaging portion of the operation plate, and when the operation plate is in positions other than the second end position the cutout is aligned with the engagement plate to release the engagement plate for upward movement;

the engaging portion has an inclined surface adjacent to the cutout for guiding the engagement plate under the engaging portion; and the opposite ends of the cam groove comprise linear paths extending along the longitudinal direction of the operation plate and connected by the inclined path.

2. A binding tool according to claim 1, wherein the engagement plate is elastic, and is positioned so that when the engagement plate is under the engaging portion the engagement plate is elastically deformed to generate a force holding the rings tightly closed.

* * * * *